United States Patent [19]

Heinen et al.

[11] 4,256,706

[45] Mar. 17, 1981

[54] LEACHING AGGLOMERATED GOLD - SILVER ORES

[75] Inventors: Harold J. Heinen, Reno; Gene E. McClelland, Sparks; Roald E. Lindstrom, Reno, all of Nev.

[73] Assignee: The United States of America as represented by the Secretary of the Interior, Washington, D.C.

[21] Appl. No.: 141,088

[22] Filed: Apr. 17, 1980

Related U.S. Application Data

[63] Continuation-in-part of Ser. No. 29,952, Apr. 13, 1979, abandoned, and Ser. No. 29,953, Apr. 13, 1979, abandoned.

[51] Int. Cl.[3] ..... C01G 5/00; C01G 7/00

[52] U.S. Cl. ..... 423/29; 75/3; 75/105; 75/118 R

[58] Field of Search ..... 423/27, 29; 75/101 R, 75/105, 106, 118, 3

[56] References Cited

U.S. PATENT DOCUMENTS

| | | | |
|---|---|---|---|
| 588,476 | 8/1897 | Rhodes | 423/27 |
| 658,938 | 10/1900 | Alzugary | 75/105 |
| 868,551 | 10/1907 | Hall | 75/105 |
| 2,009,667 | 7/1935 | Keyes | 423/29 |

FOREIGN PATENT DOCUMENTS

| | | | |
|---|---|---|---|
| 517867 | 2/1940 | United Kingdom | 75/3 |

OTHER PUBLICATIONS

*Chemical Abstracts*, vol. 68, No. 97,730c (1968).

*Primary Examiner*—Brian E. Hearn
*Attorney, Agent, or Firm*—William S. Brown; Donald A. Gardiner

[57] ABSTRACT

Percolation leaching of gold or silver ores, tailings or wastes is accomplished by a process comprising initial agglomeration of fines in the feed by means of a binding agent and cyanide solution, followed by aging and, subsequently, leaching to recover gold or silver values.

7 Claims, No Drawings

LEACHING AGGLOMERATED GOLD - SILVER ORES

This application is a continuation-in-part of applications Ser. Nos. 29,952 and 29,953, filed Apr. 13, 1979, both abandoned.

Conventional percolation leaching, particularly heap leaching, has generally proven to be a low-capital, low-operating cost technique for processing low-grade gold or silver ores, tailings or wastes. However, many such materials are not amenable to existing percolation leaching processes because of the presence of excessive amounts of clays, or of fines generated during crushing of the feed materials. These constituents in the feed impede uniform flow of leach solution through the feed beds, causing channeling and reducing precious metal recovery. In the mineral processing field, slimes are generally defined as the fraction of an ore that is too fine to be commercially exploited by processes developed for the coarser size fractions. Frequently slimes are considered to be particles less than 50 microns in diameter. Slimes are present in most ores and mill feeds because of (1) weathering, physical abrasion, and alterations of certain rock components, and (2) the comminution of the ore to achieve liberation of the valuable mineral constituents. In prevailing heap leach cyanidation practices, the presence of slimes (clays and/or ore fines) in the feed materials impede uniform solution flow through the ore mass and channeling results which reduces precious metal extraction. In extreme cases, the presence of clays can completely seal the ore heap causing the leach solution to run off the sides of the heap rather than penetrate the ore. Because prevailing technology is inadequate to handle the slime problem in heap leach cyanidation, many of the low-grade clayey gold and silver deposits cannot be exploited.

It was found, in accordance with the process of application Ser. No. 29,953, that the efficiency of percolation leaching processes for recovery of gold or silver from such feed materials could be substantially improved by initial pretreatment of the feed with a binding agent and water to agglomerate fines contained in the feed, followed by aging of the thus-treated feed. The pretreated feed could then be subjected to conventional percolation leaching techniques to recover gold or silver values.

It was also found, in accordance with the process of application Ser. No. 29,952, that the speed and efficiency of such percolation leaching processes could be substantially improved by initially wetting the feed with a relatively concentrated alkaline cyanide solution, allowing the wetted feed to age for a time sufficient for substantially complete reaction with gold or silver values in the feed, and then leaching soluble gold or silver cyanides from the aged feed with water.

It has now been found, according to the process of the present invention, that the efficiency of percolation leaching processes for recovery of gold or silver from such feed materials may be still further improved by initial pretreatment of the feed with a binding agent and an aqueous cyanide solution to agglomerate the fines contained in the feed, as well forming soluble cyanides of gold or silver values in the feed. The method of the invention consists of wetting the crushed ore, or other finely divided feed material, with an alkaline cyanide solution considerably more concentrated than that conventionally employed, allowing the wetted ore to age for a time sufficient for agglomeration of fines in the ore and for substantially complete reaction of the cyanide with gold or silver, and then leaching soluble gold or silver cyanides from the aged ore. Essentially all of the leachable precious metal content of the ore is removed in about ten hours or less, the free cyanide and alkali content of the leach solution is very low, and the residual cyanide in the spent ore is generally only a fraction of a part per million.

Although a fairly concentrated cyanide solution is used to pretreat the ore, the ore takes up only enough cyanide to react with its precious metal content, thereby reducing total cyanide consumption as compared to conventional practice. In some cases it is not even necessary to add protective alkali to the cyanide solution, hydrolysis of the sodium cyanide being sufficient to raise the pH to the proper level.

More specifically, the invention relates to a process involving the steps of (1) mixing the feed with a binding agent, (2) wetting the feed-binding agent mixture uniformly with a closely controlled amount of cyanide solution, (3) mechanically manipulating the wetted material to effect agglomeration of fines contained in the feed, (4) aging the thus-treated feed at ambient conditions until the agglomerates have set up and developed sufficient green strength to withstand further wetting without disintegration, and the reaction of the cyanide with gold or silver values is substantially complete, and (5) subjecting the pretreated feed to conventional percolation leaching for extraction of gold or silver values. This pretreatment of the feed increases its porosity and permeability, thus enhancing the percolation flow of leach solutions through beds or heaps of the gold or silver-containing feed. Both the speed and extraction efficiency of the leaching process is thereby substantially improved. In addition, the amount or residual leach solution, specifically cyanide, in the spent feed is reduced, and the resulting pregnant leach solutions are lower in free cyanide and alkalinity, thereby facilitating recovery of gold and silver values by carbon adsorption.

Burnt lime, i.e., calcium oxide, and type II portland cement have been found to be particularly effective as binding agents in the process of the invention. However, other binding agents, such as calcium aluminate cement, magnesia, dolomite, inorganic silicates and organic long chained polymers, may also be used. In addition, other types of lime, such as hydrated and agricultural lime, and other varieties of portland cement may also be used as the binding agent. Particular combinations of these binding agents may also be effective for treatment of specific feed materials.

Flocculating agents, including lime, have been widely employed in thickening and dewatering applications, such as dewatering ore pulps, and briquetting or pelletizing finely ground concentrates into larger particles suitable for heat hardening prior to charging to an open hearth or blast furnace. The primary purpose of such procedures is production of briquettes or pellets that do not spall during thermal induration. In contrast, the objective of applicants' invention was conversion of fines in feed materials to porous agglomerates having sufficient green strength to withstand percolation leaching, as well as rapid and efficient formation of soluble cyanides of gold and silver values. Lime is also frequently used to provide protective alkalinity in conventional cyanide heap leaching. However, its use in this manner has little benefical effect on the percolation flow through ore beds.

In the process of the invention, the feed is thoroughly mixed with a small amount of the binding agent, and the mixture is then wetted with an amount of cyanide solution sufficient to cause substantial binding or agglomeration of fines in the feed, and to form soluble cyanides with a major portion of the gold or silver values when the mixture is cured or aged for a suitable period of time. Optimum amounts of binding agent and cyanide solution will vary with the type of feed and specific binding agent and cyanide solution employed. However, suitable amounts of binding agent will usually be in the range of about 5 to 15 pounds per ton of feed, with the amount of cyanide solution generally being in the range of about 8 to 16 weight percent based on the amount of feed. Close control of the amount of cyanide solution has, however, been found to be generally desirable since best results are usually obtained only when a particular amount of solution is used in the agglomeration process. This will generally be an amount sufficient to uniformly wet or dampen, but not necessarily inundate, the ore particles. Since, however, the optimum amount of solution may vary considerably with different feed materials and binding agents, this amount is best determined experimentally. By proper control of the quantity of binding agent and solution, only the fines are agglomerated, leaving the coarser fragments of the feed material relatively uneffected. This results in a granular, popcorn-like product of substantially increased porosity and permeabillity.

The cyanide solution will generally consist of aqueous sodium cyanide, although solutions of calcium or potassium cyanide may also be employed. Optimum concentration of the cyanide solution may vary considerably depending on the specific type and amount of ore, although, as discussed above, a relatively concentrated solution is employed. Concentrations of sodium cyanide of about 5 to 20 lbs per ton of solution are generally satisfactory. Sodium hydroxide, lime or sodium carbonate is employed in the cyanide solution in an amount sufficient to provide protective alkalinity as in conventional cyanide leaching practices. Generally, an amount sufficient to provide pH of about 10 to 11 is satisfactory, although in some cases the hydrolysis of the sodium cyanide will maintain optimum alkalinity without addition of alkali.

The cyanide solution may be added and admixed with the feed-binding agent mixture by any conventional means such as a pelletizer or balling machine. Agglomeration of fines in the resulting admixture is also accomplished by conventional mechanical means such as the use of a rotating disk pelletizer or balling machine to produce agglomerates, pellets or balls from the fines. Generally, admixture of the feed-binding agent mixture with the solution, and agglomeration, may be effected simultaneously by means of such mechanical devices. Although this procedure for preparation of the wetted feed-binding agent mixture is generally preferred, other methods, such as spraying a slurry of the binding agent onto the dry feed, may also be used.

The resulting material is then aged or cured, without drying, at ambient conditions for a period of time sufficient to cause the agglomerates to set up and develop sufficient green strength to withstand further wetting without disintegration, as well as effecting reaction of the cyanide solution with gold or silver values. Although optimum aging time may also vary considerably with specific feed material and binding agent, suitable times will usually fall within the range of about 5 to 72 hours. Use of appropriate accelerators, particularly where the binding agent is cement, may, however, reduce the required aging considerably. Again, however, the time of aging has been found to be important to achievement of best results and optimum aging time should, therefore, be determined experimentally in each case.

Leaching of the thus-pretreated feed to extract gold or silver values is accomplished by conventional percolation leaching procedures, such as heap leaching or vat leaching. Such procedures consist of percolation of leach solution through a body of the feed material in order to extract gold or silver values in the form of cyanide complexes of the metals. Details of such procedures are well known in the art and do not constitue an essential aspect of the invention. A detailed description of heap leaching of gold ores, e.g., is given in Bureau of Mines Information Circular 8770, 1978.

The leach solution may consist of water or a dilute cyanide solution, preferably sodium cyanide solution of a concentration of about 0.1 to 0.5 lb/ton of solution. It has been found, however, in accordance with a preferred embodiment of the invention, that the process is generally most efficiently carried out by means of initial leaching with water, followed by recovery of the gold or silver values by conventional means, e.g., by adsorption on activated carbon, and recycle of the leach solution for further leaching of the pretreated feed. Since the leaching procedure results in accumulation of small concentrations of cyanide in the aqueous leachant, the leach solution in subsequent leaching steps will consist of a dilute cyanide solution. Generally, the leach solution may be recycled throughout the leaching period without substantial decrease in leaching efficiency. The invention, and the advantages thereof, will now be more specifically illustrated by the following examples. The percolation leach tests of these examples were conducted on 50-lb charges of feed material in a plexiglass column 5 feet high with an inside diameter of 5.5 inches to make a bed about 4 feet in height. Twelve liters of leach solution, either water of dilute cyanide solution, was employed. After bedding the feed materials in the leach column, downward directed percolation leaching was initiated. The pregnant liquor was collected in a sump, pumped upward through activated carbon for silver-gold recovery and the resulting barren solution was returned to the top of the leach column. The leach solution was recirculated through the leaching-carbon adsorption system until a steady-state flow rate had been achieved. Flow rate measurements were taken daily for a period of one week, and averaged to determine the percolation flow rate.

Example 1

In this example, two gold ore samples from the same property were employed in leaching experiments. The first sample was a surface material containing 0.1 oz Au/ton and only small amounts of clayey and fine material. The second sample was from 45-90 feet below the surface and contained 0.2 oz Au/ton of ore and significant amounts of clayey and fine material. A series of three column leach test using 50 lbs of ore crushed to a nominal $\frac{3}{8}$ inch feed size were conducted on each of the two samples. The three tests consisted of: (1) a baseline test with no pretreatment (conventional percolation leach), (2) a test employing agglomeration of fines in the feed with a combination of type II portland cement, in an amount of 10 lbs/ton of feed, and water, in amount of 7.7–12 weight percent based on the amount of feed, and (3) a test employing agglomeration of fines in the feed and formation of soluble gold cyanide by means of a combination of the same amount of type II portland cement and an aqueous sodium cyanide, containing 8.7–13.5 lb NaCN/ton of solution, the amount of solution being 7.7–12 weight percent based on the amount of feed.

Results of these tests are shown in Table 1. The data indicate that agglomeration of fines of the surface material was not essential for an adequate percolation rate (9.1 gal/hr/ft$^2$), although particle agglomeration with portland cement and either water or cyanide solution resulted in substantially improved percolation rates (19.2 and 21.1 gal/hr/ft$^2$, respectively). Moreover, pretreatment with the combination of cement and cyanide solution resulted in substantially reduced leaching time.

Where, however, the feed consisted of the clayey gold ore sample, agglomeration of fines, with the combination of cement and either water or cyanide solution, was essential to achievement of adquate percolation rates (0.5 vs 19.7 and 19.5 gal/hr/ft$^2$). Furthermore, required leaching time was substantially reduced, particularly when the combination of cement and cyanide solution was employed in pretreatment.

TABLE 1

| Sample | Pretreatment | Pertinent column leach data from six percolation leach experiments: Experimental calculated head, oz Au/ton ore | Reagents: Cement, lb/ton ore | Reagents: Cyanide, lb/ton soln | Reagents: Moisture, wt-pct | Percolation rate, gal/hr/ft$^2$ | Leaching period, days | $CN^-$ cons, lb/ton ore | Au recovery, pct total Au |
|---|---|---|---|---|---|---|---|---|---|
| Surface | None | 0.10 | — | 2 | — | 9.1 | 5 | 0.4 | 90.1 |
| | Particle agglomeration with cement + $H_2O$ | .11 | 10 | 2 | 7.7 | 19.2 | 5 | .4 | 90.9 |
| | Particle agglomeration with cement + $CN^-$ | .11 | 10 | 13.5* | 7.7 | 21.1 | 1.5 | .3 | 91.0 |
| Clayey ore | None | .21 | — | 2 | — | .5 | 9 | .4 | 90.6 |
| | Particle agglomeration with cement + $H_2O$ | .23 | 10 | 2 | 12.0 | 19.7 | 5 | .4 | 91.2 |
| | Particle agglomeration with cement + $CN^-$ | .23 | 10 | 8.7* | 12.0 | 19.5 | 2 | .3 | 91.4 |

*based on cyanide content of the pretreatment solution.

TABLE 2

| Sample | Pretreatment | Pertinent column leach data from three percolation leach experiments on a high clay containing silver ore: Experimental calculated head, oz Au/ton ore | Reagents: Cement, lb/ton ore | Reagents: Cyanide, lb/ton soln | Reagents: Moisture, wt-pct | Percolation rate, gal/hr/ft$^2$ | Leaching period, days | $CN^-$ cons, lb/ton ore | Au recovery, pct total Au |
|---|---|---|---|---|---|---|---|---|---|
| Clayey silver ore | None | 2.3 | — | 1.0 | — | 0.1 | 22 | 0.9 | 73.8 |
| Clayey silver ore | Particle agglomeration with cement + $H_2O$ | 2.4 | 10 | 1.0 | 9.6 | 15.1 | 11 | 0.6 | 75.4 |
| Clayey silver ore | Particle agglomeration with cement + $CN^-$ | 2.3 | 10 | 12.0* | 9.0 | 19.0 | 2.3 | 0.6 | 78.3 |

*Based on cyanide content of the pretreatment solution.

EXAMPLE 2

In this example, an extremely clayey silver ore containing 2.3 oz Ag/ton was employed in leaching experiments. A series of three column leach tests using 50 lbs of ore crushed to a nominal ⅜ inch feed size were conducted in essentially the same manner as the leaching experiments of example 1. Results are shown in Table 2. The data indicate that agglomeration of fines with portland cement and water was effective in improving percolation rate and substantially reducing leaching time for maximum silver recovery as compared to conventional heap leacing techniques. Cyanide consumption was also reduced by 33 percent.

Pretreatment with a combination of portland cement and cyanide solution was also effective in improving percolation rates and reducing cyanide consumption, but was even more effective in reducing the leaching time (2.3 days vs 22 days for no pretreatment and 11 days for pretreatment with the combination of cement and water).

We claim:

1. A process for percolation leaching of gold or silver values from a feed material consisting of ores, tailings or wastes comprising:

(1) admixing the feed with about 0.25 to 0.75 weight percent of a binding agent consisting of lime, portland cement, or mixtures thereof, and about 8 to 16 weight percent of an aqueous cyanide solution, (2) mechanically manipulating the admixture to effect agglomeration of fines in the feed, (3) aging the admixture at ambient conditions for a time sufficient to provide the resulting agglomerates with green strength sufficient to withstand further wetting without disintegration, and for substantial reaction of the cyanide with gold or silver values in the feed, and (4) subjecting the aged admixture to percolation leaching with water or cyanide solution, whereby gold or silver is selectively leached.

2. The process of claim 1 in which the feed material is a low-grade clayey gold or silver ore, tailing or waste.

3. The process of claim 2 in which the binding agent is portland cement.

4. The process of claim 1 in which the aging time is about 5 to 72 hours.

5. The process of claim 1 in which the aqueous cyanide solution consists of a 1.16 to 1.27 molar solution of sodium cyanide.

6. The process of claim 1 in which the percolation leaching consists of heap leaching.

7. The process of claim 1 in which the percolation leaching consists of vat or flood leaching.

* * * * *